US009316943B1

(12) United States Patent
Yokoyama

(10) Patent No.: US 9,316,943 B1
(45) Date of Patent: Apr. 19, 2016

(54) SUPPLY DEVICE, DEVELOPING DEVICE, AND IMAGE FORMING APPARATUS

(71) Applicant: FUJI XEROX CO., LTD., Tokyo (JP)

(72) Inventor: Yuki Yokoyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/694,569

(22) Filed: Apr. 23, 2015

(30) Foreign Application Priority Data

Dec. 25, 2014 (JP) ..... 2014-262900

(51) Int. Cl.
*G03G 15/08* (2006.01)

(52) U.S. Cl.
CPC ..... *G03G 15/0831* (2013.01)

(58) Field of Classification Search
CPC ..... G03G 15/104; G03G 15/10; G03G 2215/0119; G03G 2215/0658; G03G 15/0865; G03G 15/0831; G03G 2215/0626; G03G 13/10; G03G 9/12
USPC ..... 399/237, 238
See application file for complete search history.

(56) References Cited

U.S. PATENT DOCUMENTS 3,851,964 A * 12/1974 Smith ..... G03G 5/0575 399/318
6,009,294 A * 12/1999 Liu ..... G03G 15/0121 347/131
6,141,517 A * 10/2000 Kuramochi ..... G03G 15/0121 399/233
2002/0197083 A1 12/2002 Yoshino et al.
2003/0059234 A1 3/2003 Sasaki et al.
2004/0175208 A1* 9/2004 Ichida ..... G03G 15/161 399/302
2004/0190943 A1 9/2004 Sasaki et al.
2004/0197116 A1 10/2004 Yoshino et al.
2005/0147423 A1 7/2005 Sasaki et al.
2007/0147897 A1* 6/2007 Izawa ..... G03G 15/104 399/237

FOREIGN PATENT DOCUMENTS

JP 2002-278305 A 9/2002

* cited by examiner

*Primary Examiner* — Francis Gray
(74) *Attorney, Agent, or Firm* — Oliff PLC

(57) ABSTRACT

A supply device for a liquid developer includes plural supply members, and a control section, wherein each of the supply member has a cylindrical shape with recesses disposed on an outer peripheral surface, faces a developing member developing while rotating, draws up the liquid developer accommodated in an accommodation section while rotating, supplies the liquid developer to the outer peripheral surface of the developing member, and is arranged along a rotation direction of the developing member, and wherein the control section controls a rotation starting time for the plural supply members so that a position of a peak of a thickness of the liquid developer supplied to the outer peripheral surface of the developing member by a first supply member is different from a position of a peak of a thickness of the liquid developer supplied to the outer peripheral surface of the developing member by a second supply member.

16 Claims, 11 Drawing Sheets

SUPPLY DEVICE, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2014-262900 filed Dec. 25, 2014.

BACKGROUND

Technical Field

The present invention relates to a supply device, a developing device, and an image forming apparatus.

SUMMARY

According to an aspect of the invention, there is provided a supply device for a liquid developer including:

plural supply members; and a control section, wherein each of the supply member has a cylindrical shape with recesses regularly disposed on an outer peripheral surface, faces a developing member developing while rotating, draws up the liquid developer accommodated in an accommodation section while rotating, supplies the liquid developer to the outer peripheral surface of the developing member, and is arranged along a rotation direction of the developing member, and wherein when the developing member develops, the control section controls a rotation starting time for the plural supply members so that a position of a peak of a thickness of the liquid developer supplied to the outer peripheral surface of the developing member by a first supply member is different from a position of a peak of a thickness of the liquid developer supplied to the outer peripheral surface of the developing member by a second supply member.

BRIEF DESCRIPTION OF THE DRAWINGS

Exemplary embodiments of the present invention will be described in detail based on the following figures, wherein.

DETAILED DESCRIPTION

Figure 1:
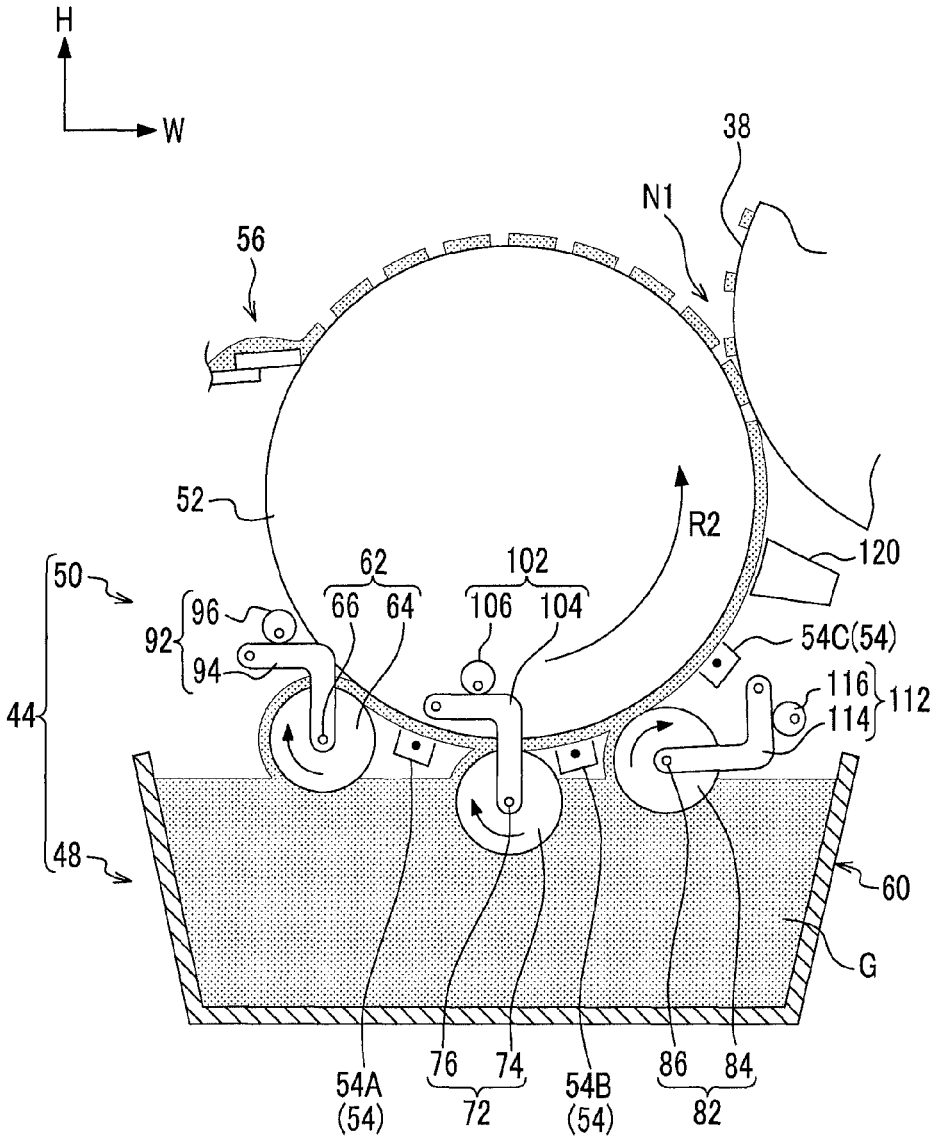
FIG. 1 is a configuration diagram illustrating a developing device according to an exemplary embodiment of the invention.

An example of a supply device, a developing device, and an image forming apparatus according to an exemplary embodiment of the invention will be described with reference to FIGS. 1 to 12. An arrow H illustrated in the drawings represents a vertical direction (perpendicular direction) of the device, and an arrow W represents a width direction (horizontal direction) of the device.

Overall Configuration

Figure 10:
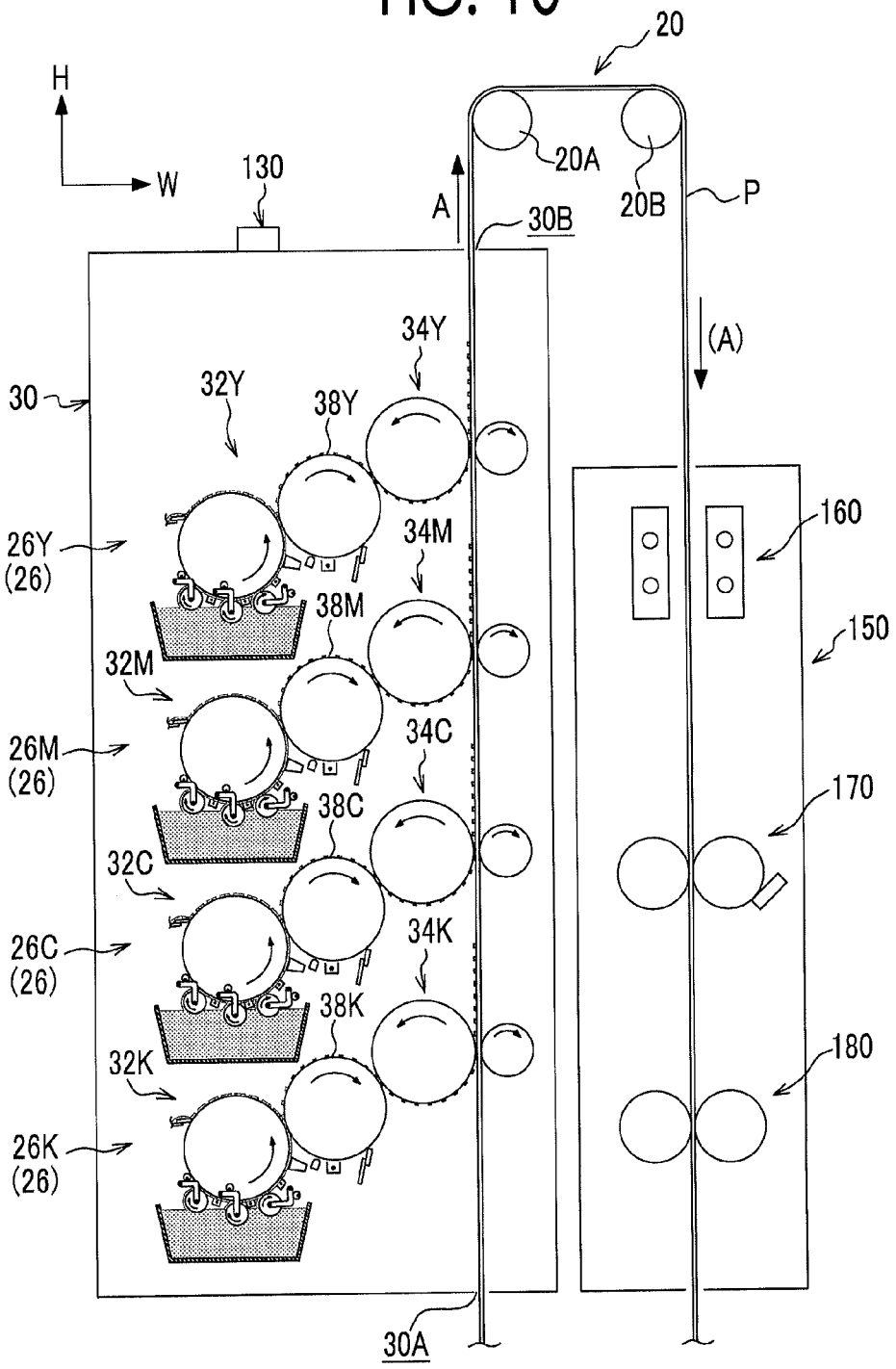
FIG. 10 is a schematic configuration diagram illustrating the image forming apparatus according to the exemplary embodiment of the invention.

As illustrated in FIG. 10, an image forming apparatus includes a transport section 20 which transports a continuous paper P as a recording medium, an image forming section 26 which forms a toner image, and a fixing device 150 which fixes the toner image to the continuous paper P.

Transport Section

The transport section 20 has a function of transporting the continuous paper P in a direction of an illustrated arrow A (transport direction) at predetermined transport speed. The transport section 20 further includes a pair of transport rollers 20A and 20B around which the continuous paper P is wound and which are arranged in the width direction of the device. The transport roller 20A is arranged on an upstream side (left side in the drawing) in a transport direction of the continuous paper P (hereinafter, referred to as a "medium transport direction") from the transport roller 20B.

In this configuration, the continuous paper P is transported from a lower side to an upper side in the drawing, on the upstream side from the transport roller 20A in the medium transport direction, and is transported from the upper side to the lower side in the drawing, on a downstream side from the transport roller 20B in the medium transport direction. The transport speed of the continuous paper P is set to 60 m/min as an example.

Image Forming Section

The image forming section 26 includes an image forming section 26Y for forming a yellow (Y) image, an image forming section 26M for forming a magenta (M) image, an image forming section 26C for forming a cyan (C) image, and an image forming section 26K for forming a black (K) image. The image forming section 26K, the image forming section 26C, the image forming section 26M, and the image forming section 26Y are arranged in this order from the upstream side in the medium transport direction. The image forming section 26K, the image forming section 26C, the image forming section 26M, and the image forming section 26Y are arranged in a housing 30.

An opening 30A through which the continuous paper P transported by the transport section 20 enters the housing 30 is formed in a lower side portion of the housing 30. An opening 30B through which the continuous paper P entering the housing 30 is discharged outward from the housing 30 is formed in an upper side portion of the housing 30.

The image forming section 26K, the image forming section 26C, the image forming section 26M, and the image forming section 26Y have basically the same configuration except for a liquid developer G in use. In the following description, if distinction therebetween is not particularly needed, "Y", "M", "C", and "K" at the ends of the reference numerals will be omitted.

Figure 9:
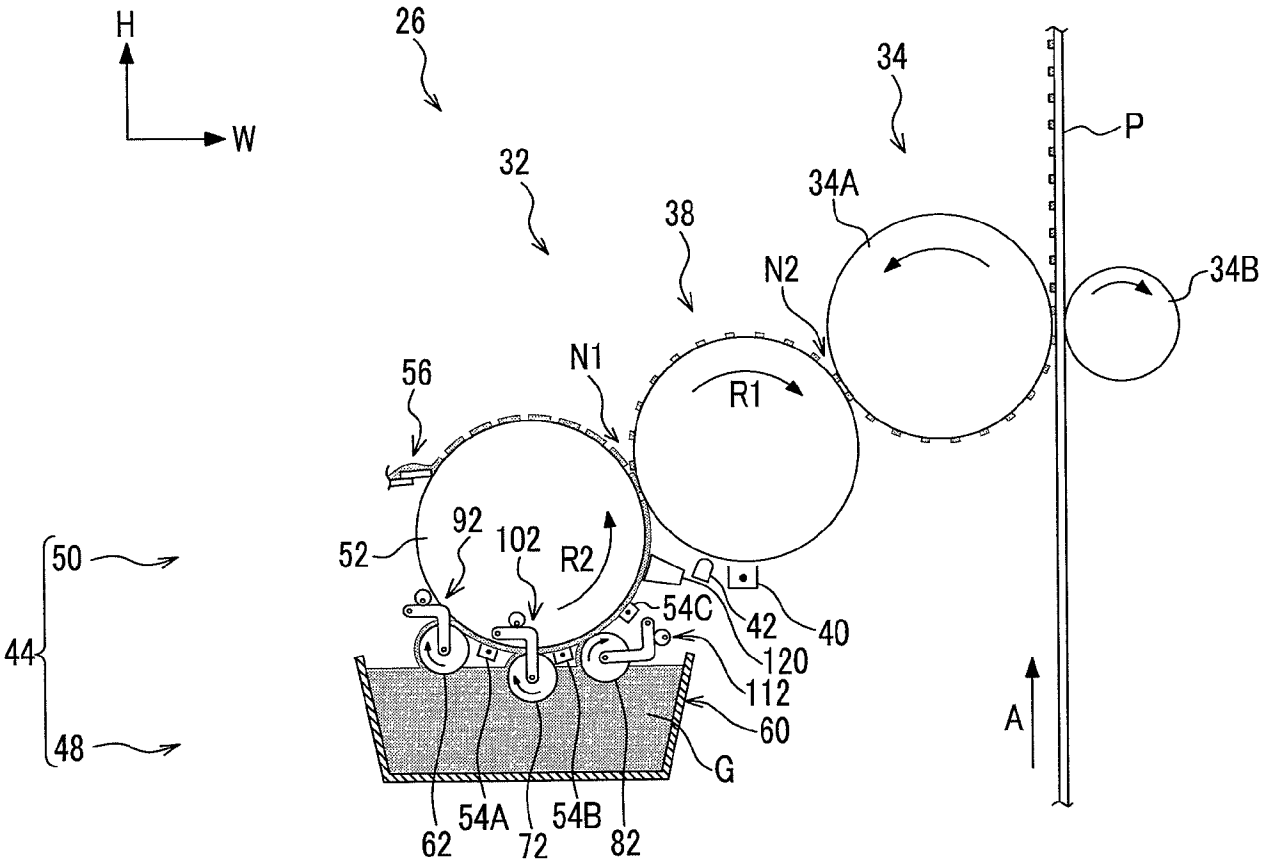
FIG. 9 is a configuration diagram illustrating an image forming unit included in an image forming apparatus according to the exemplary embodiment of the invention.

As illustrated in FIG. 9, the image forming section 26 includes an image forming unit 32 for forming the toner image by using the liquid developer G containing toner and non-volatile oil, and a transfer unit 34 for transferring the toner image formed by the image forming unit 32 to the continuous paper P.

Image Forming Unit

The image forming unit 32 includes an image holding member 38 for holding the toner image, a charging device 40 for charging the image holding member 38, an exposure device for forming an electrostatic latent image by emitting exposure light to the image holding member 38, and a developing device 44 for developing the electrostatic latent image formed on the image holding member 38 as the toner image.

Image Holding Member

The image holding member 38 has a cylindrical shape, and is rotatably driven (direction of an arrow R1) by driving means (not illustrated). The image holding member 38 has a substrate made of aluminum, and a photosensitive layer (not illustrated) formed of an undercoat layer, a charge generating layer, and a charge transport layer sequentially on the substrate.

Charging Device

In the exemplary embodiment, the charging device 40 is a scorotron-type charging device, and is arranged so as to face an outer peripheral surface of the image holding member 38. The charging device 40 charges the outer peripheral surface of the image holding member 38.

Exposure Device

In the exemplary embodiment, the exposure device 42 is configured to include an LED print head, and is arranged so as to face the outer peripheral surface of the image holding member 38 on the downstream side of the charging device 40 in the rotation direction of the image holding member 38. The exposure device 42 emits exposure light to the outer peripheral surface of the image holding member 38 charged by the charging device 40, and forms an electrostatic latent image on the outer peripheral surface.

Developing Device

The developing device 44 includes a developing section 50 for delivering the liquid developer G to the electrostatic latent image formed in the image holding member 38, and a supply section 48 as an example of a supply device for supplying the liquid developer G to the developing section 50. The liquid developer G is obtained by dispersing powder toner in oil. The supply section 48 will be described in detail later.

Developing Section

The developing section 50 includes a developing roller 52 which is rotatably driven in the direction of an arrow R2 by driving means (not illustrated), and which is an example of a developing member in which the liquid developer G is supplied to the outer peripheral surface. The developing section 50 further includes a charging member 54 which is arranged to face the developing roller 52 and a collection blade 56 which collects the liquid developer G remaining on the outer peripheral surface of the developing roller 52.

A developing voltage is applied to the developing roller 52 by a power source (not illustrated). An electric field for developing the electrostatic latent image formed on the outer peripheral surface of the image holding member 38 is formed between the developing roller 52 and the image holding member 38 (nip portion N1). An electric field for supplying the liquid developer G to the outer peripheral surface of the developing roller 52 from supply rollers 62, 72, and 82 is formed between the developing roller 52 and the supply rollers 62, 72, and 82 (to be described later).

In the exemplary embodiment, the charging member 54 is a scorotron-type charging device, and is used in order to charge toner contained in the liquid developer G. As illustrated in FIG. 1, the charging member 54 is disposed at three locations on the upstream side from the nip portion N1 in the rotation direction of the developing roller 52 so as to face the outer peripheral surface of the developing roller 52. Specifically, a charging member 54A is arranged between the supply roller 62 and the supply roller 72 (to be described later), a charging member 54B is arranged between the supply roller 72 and the supply roller 82, and a charging member 54C is arranged between the supply roller 82 and the nip portion N1.

The collection blade 56 has a plate shape formed of a rubber material, and is arranged on the downstream side from the nip portion N1 in the rotation direction of the developing roller 52 so that an end portion thereof contacts with the outer peripheral surface of the developing roller 52.

In this configuration, the charging member 54 charges the toner contained in the liquid developer G supplied to the outer peripheral surface of the developing roller 52. The developing roller 52 delivers the liquid developer G containing the charged toner to the electrostatic latent image formed in the image holding member 38. In this manner, the developing section 50 develops the electrostatic latent image formed in the image holding member 38 as a toner image.

The collection blade 56 collects the liquid developer G which is not delivered to the image holding member 38 and remains on the outer peripheral surface of the developing roller 52.

Transfer Unit

As illustrated in FIG. 9, the transfer unit 34 is configured to include a transfer roller 34A which is arranged to face the image holding member 38 and to which the toner image formed in the image holding member 38 is transferred, and a back-up roller 34B which is arranged on a side opposite to the transfer roller 34A across the continuous paper P.

A primary transfer voltage is applied to the transfer roller 34A by a power supply (not illustrated). In this manner, an electric field for transferring the toner image formed on the image holding member 38 to the transfer roller 34A is formed between the transfer roller 34A and the image holding member (nip portion N2).

A secondary transfer voltage is applied to the back-up roller 34B by a power supply (not illustrated). In this manner, an electric field for transferring the toner image formed on the transfer roller 34A to the continuous paper P is formed between the back-up roller 34B and the transfer roller 34A.

Fixing Device

As illustrated in FIG. 10, the fixing device 150 includes a heat section 160 which heats the continuous paper P having the transferred toner image, an oil removing section 170 which removes oil from the continuous paper P, and a fixing section 180 which fixes the toner image to the continuous paper P.

In this configuration, the heat is supplied to the continuous paper P by the heat section 160, the toner and the oil which are contained in the liquid developer G on the continuous paper P are separated from each other, and an oil layer is formed on an upper layer of the toner. The oil is removed by the oil removing section 170, the continuous paper P is heated and pressurized by the fixing section 180, and the toner image is fixed to the continuous paper P.

Operation of Overall Configuration

The image holding member 38 of the image forming unit 32 of each color is rotated, and the outer peripheral surface of the image holding member 38 is charged by the charging device (refer to FIG. 9). Thereafter, the exposure device 42 exposes the charged outer peripheral surface of the image holding member 38 according to image data received from an image signal processing unit (not illustrated), thereby forming an electrostatic latent image (not illustrated) on the outer peripheral surface of the image holding member 38. The electrostatic latent image is developed as the toner image by the developing device 44.

The toner image formed on the outer peripheral surface of the rotating image holding member 38 is primarily transferred to the transfer roller 34A. The toner image primarily transferred to the transfer roller 34A is transferred to the transported continuous paper P. At this time, the oil with the toner image is transferred to the continuous paper P. This process is performed by the image forming section 26 of each color, and thus the toner image having each color superimposed thereon is formed on the continuous paper P.

The toner configuring the toner image formed on the transported continuous paper P is heated up to toner melting temperature or higher by the heat from the heat section 160 (refer to FIG. 10). Thereafter, the oil of the toner image on the continuous paper P is partially removed by the oil removing section 170. Thereafter, the toner image on the continuous paper P from which the oil is partially removed is heated and fixed to the continuous paper P by the fixing section 180.

Main Part Configuration

Supply Section

As illustrated in FIG. 1, the supply section 48 is arranged on a lower side of the developing roller 52, and includes a accommodation vessel 60 which accommodates the liquid developer G, and the three supply rollers 62, 72, and 82 which draw up the liquid developer G from the accommodation vessel 60 and supply the liquid developer G to the outer peripheral surface of the developing roller 52. These supply rollers 62, 72, and 82 are examples of a supply member.

The supply section 48 includes movement members 92, 102, and 112 which individually move the supply rollers 62, 72, and 82 to a supplying position facing the outer peripheral surface of the developing roller 52, and which individually move the supply rollers 62, 72, and 82 to a separating position separated from the developing roller 52. The supply section 48 further includes a detection member 120 which detects a thickness of the liquid developer G supplied to the outer peripheral surface of the developing roller 52, and a control section 100 (refer to FIG. 6) which controls an operation of each section.

Accommodation Vessel

The accommodation vessel 60 has a box shape whose upper side is open, and internally accommodates the liquid developer G. The liquid developer G employed in the exemplary embodiment is obtained by dispersing powder toner in non-volatile oil.

Supply Roller

The supply rollers 62, 72, and 82 located at the supplying position are arranged in this order from the upstream side in the rotation direction (direction of an arrow R2 in the drawing) of the developing roller 52 so as to face the outer peripheral surface of the developing roller 52. A lower side portion of the respective supply rollers 62, 72, and 82 is immersed in the liquid developer G accommodated in the accommodation vessel 60. The supply rollers 62, 72, and 82 have the same configuration except for the respectively arranged positions. Accordingly, hereinafter, the supply roller 62 will be mainly described.

Figure 5A:
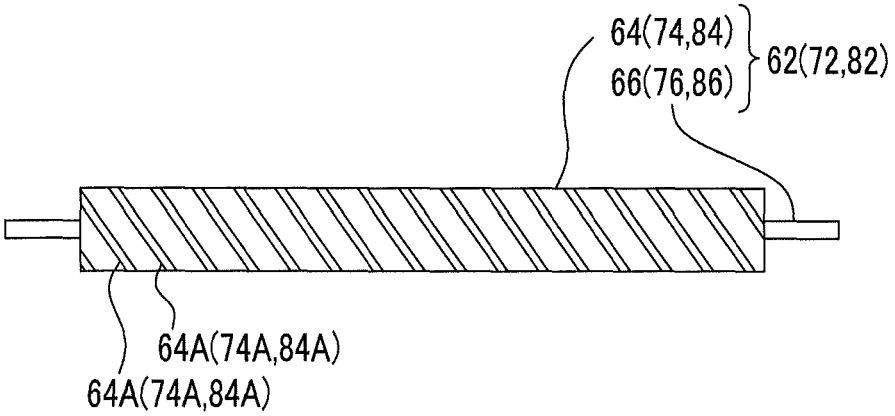
FIGS. 5A and 5B are side views illustrating supply rollers used in a supply device according to the exemplary embodiment of the invention.
Figure 5B:
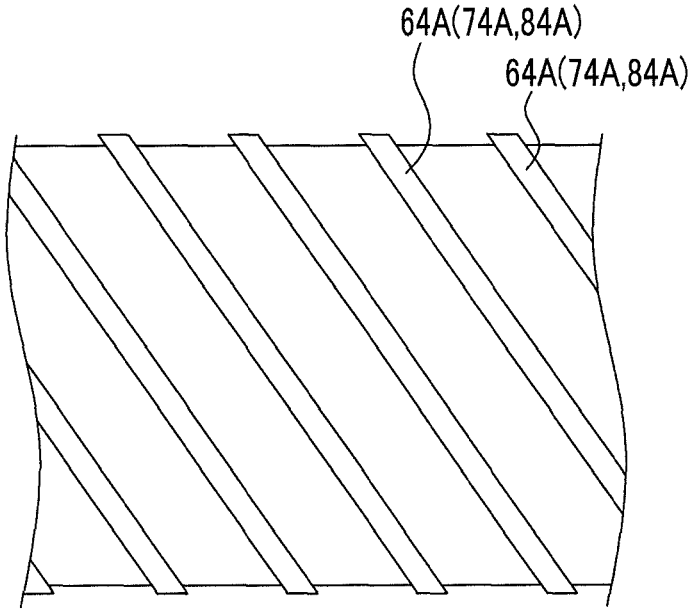

The supply roller 62 includes a main body portion 64 formed of ceramic and a shaft portion 66. As illustrated in FIGS. 5A and 5B, recesses 64A which are regularly disposed are formed on the outer peripheral surface of the main body portion 64 in order to draw up the liquid developer G. Specifically, as an example, a width of the recess 64A is set to 80 μm, and a depth thereof is set to 30 μm. The multiple recesses 64A are formed in an annular shape on the outer peripheral surface of the main body portion 64. As an example, 300 recesses 64A are formed within every axial distance 25.4 mm (1 inch). The respective recesses 64A are tilted to the axial direction of the supply roller 62. FIGS. 5A and 5B illustrate the exaggerated recesses 64A.

Figure 6:
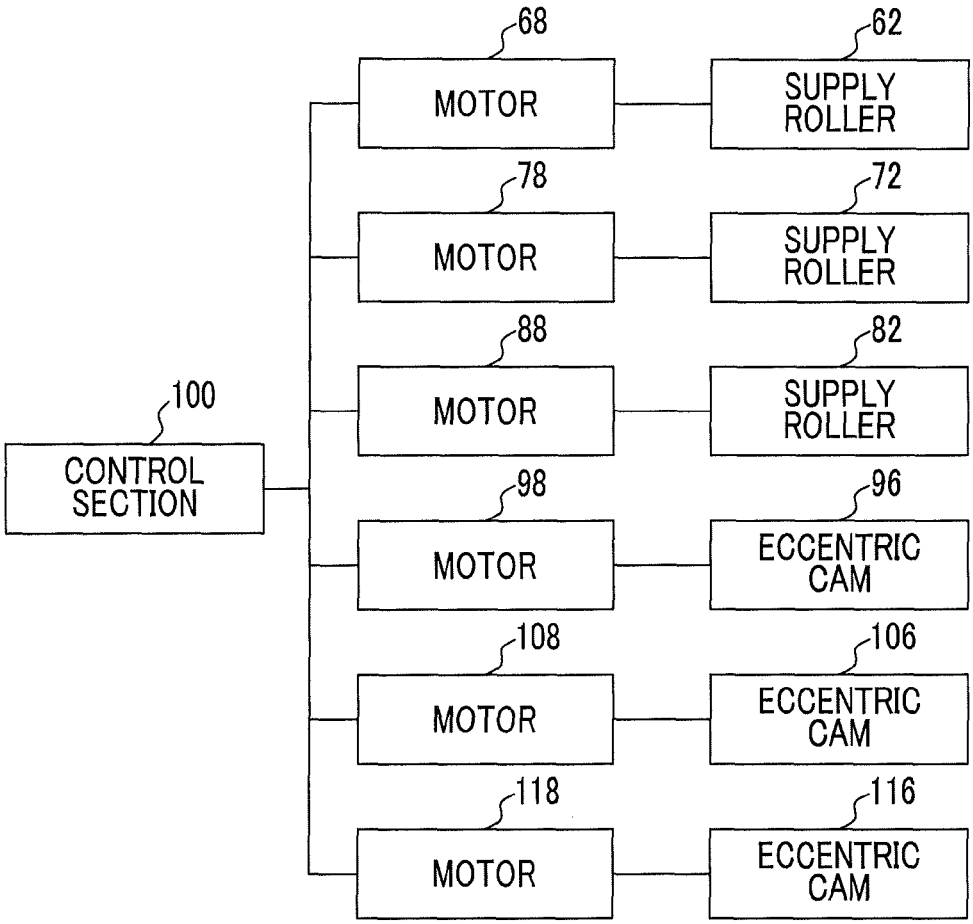
FIG. 6 is a block diagram illustrating control of a control section included in the supply device according to the exemplary embodiment of the invention.

A motor 68 which is a stepping motor for generating driving power to rotate the supply roller 62 is disposed in the supply section 48 (refer to FIG. 6).

A blade (not illustrated) for adjusting a layer coat of the liquid developer G adhering to the main body portion 64, and a charging device (not illustrated) for charging the toner contained in the liquid developer G adhering to the main body portion 64 to have positive polarity as an example are disposed therein so as to face the outer peripheral surface of the main body portion 64.

In this configuration, the driving power of the motor 68 is transmitted to the supply roller 62 via multiple gears (not illustrated). The rotating supply roller 62 draws up the liquid developer G accommodated in the accommodation vessel 60. An electric field formed between the supply roller 62 and the developing roller 52 causes the liquid developer G drawn up by the supply roller 62 to be supplied to the outer peripheral surface of the developing roller 52. In this manner, a coat (layer) of the liquid developer G is formed on the outer peripheral surface of the developing roller 52.

Hitherto, the supply roller 62 has been described as an example. However, similarly to the supply roller 62, the supply roller 72 also includes a main body portion 74 and a shaft portion 76. A recess 74A is formed in the main body portion 74 (refer to FIG. 5A). A motor 78 for generating driving power to rotate the supply roller 72 is disposed therein (refer to FIG. 6).

Similarly to the supply roller 62, the supply roller 82 also includes a main body portion 84 and a shaft portion 86. A recess 84A is formed in the main body portion 84 (refer to FIG. 5A). A motor 88 for generating driving power to rotate the supply roller 82 is disposed therein (refer to FIG. 6).

Movement Member

As described above, the movement members 92, 102, and 112 individually move the supply rollers 62, 72, and 82 to the supplying position facing the outer peripheral surface of the developing roller 52, and individually move the supply rollers 62, 72, and 82 to the separating position separated from the developing roller 52 (refer to FIG. 1).

Specifically, the movement member 92 moves the supply roller 62, the movement member 102 moves the supply roller 72, and the movement member 112 moves the supply roller 82. The supply rollers 62, 72, and 82 located at the supplying position may supply the liquid developer G to the outer peripheral surface of the developing roller 52. It is impossible for the supply rollers 62, 72, and 82 located at the separating position to supply the liquid developer G to the outer peripheral surface of the developing roller 52. The movement members 92, 102, and 112 have the same configuration except for the respectively arranged positions. Accordingly, hereinafter, the movement member 92 will be mainly described.

The movement member 92 includes a pair of L-shaped links 94 for rotatably supporting both end portions of the supply roller 62, a pair of eccentric cams 96 whose outer peripheral surface contacts with an edge portion of the link 94, and a pair of biasing members (not illustrated) for biasing the link 94 against the outer peripheral surface of the eccentric cam 96. The movement member 92 further includes a motor 98 which is a stepping motor for generating driving power to rotate the pair of eccentric cams 96 (refer to FIG. 6). Specifically, one end side of the link 94 is rotatably supported by a frame member (not illustrated), and the other end side of the link 94 rotatably supports the supply roller 62.

In this configuration, the driving power of the motor 98 is transmitted to the eccentric cam 96 via multiple gears (not illustrated). The driving power of the motor 98 rotates the eccentric cam 96, thereby rotating the link 94. In this manner, the movement member 92 moves the supply roller 62 to the supplying position (refer to FIG. 1) facing the outer peripheral surface of the developing roller 52, and moves the supply roller 62 to the separating position (refer to FIG. 4) separated from the outer peripheral surface of the developing roller 52.

Hitherto, the movement member 92 has been described as an example. However, similarly to the movement member 92, the movement member 102 also includes a link 104, an eccentric cam 106, and a motor 108 (refer to FIG. 6) for rotating the eccentric cam 106.

Similarly to the movement member 92, the movement member 112 also includes a link 114, an eccentric cam 116, and a motor 118 (refer to FIG. 6) for rotating the eccentric cam 116.

Detection Member

In the exemplary embodiment, the detection member 120 is configured to include a laser displacement gauge. As illustrated in FIG. 1, the detection member 120 is arranged on the downstream side from the charging member 54C and on the upstream side from the nip portion N1 in the rotation direction of the developing roller 52 so as to face the outer peripheral surface of the developing roller 52. The detection member 120 detects periodic information related to the thickness of the liquid developer G supplied to the outer peripheral surface of the developing roller 52 (details to be described later).

Control Section

As illustrated in FIG. 6, the control section 100 controls the drive of the motors 68, 78, and 88 for rotating the supply rollers 62, 72, and 82, and controls the drive of the motors 98, 108, and 118 for rotating the eccentric cams 96, 106, and 116. The control section 100 controls a rotation starting time for the supply rollers 62, 72, and 82, based on periodic information related to the thickness of the liquid developer G detected by the detection member 120 (refer to FIG. 1) and positional information of the supply rollers 62, 72, and 82. Here, the positional information of the supply rollers 62, 72, and 82 includes positional information among the respective supply rollers 62, 72, and 82, and rotation angle information of the supply rollers 62, 72, and 82.

The control of the control section 100 will be described in an operation of a main part configuration (to be described later).

Others

As illustrated in FIG. 10, the image forming apparatus 10 includes an input unit 130 for inputting paper types used for the image forming apparatus 10.

Operation of Main Part Configuration

Next, the operation of the main part configuration will be described.

When the image forming apparatus 10 is shipped from a factory, the supply roller 62, 72, and 82 are moved to the separating position, and the liquid developer G is not accommodated in the accommodation vessel 60. If the image forming apparatus 10 is delivered to a dealer or a user, the liquid developer G is accommodated in the accommodation vessel 60, and power is supplied to the image forming apparatus 10 for the first time, the control section 100 actuates the motor 98 so as to rotate the eccentric cam 96 (refer to FIG. 6).

Figure 2:
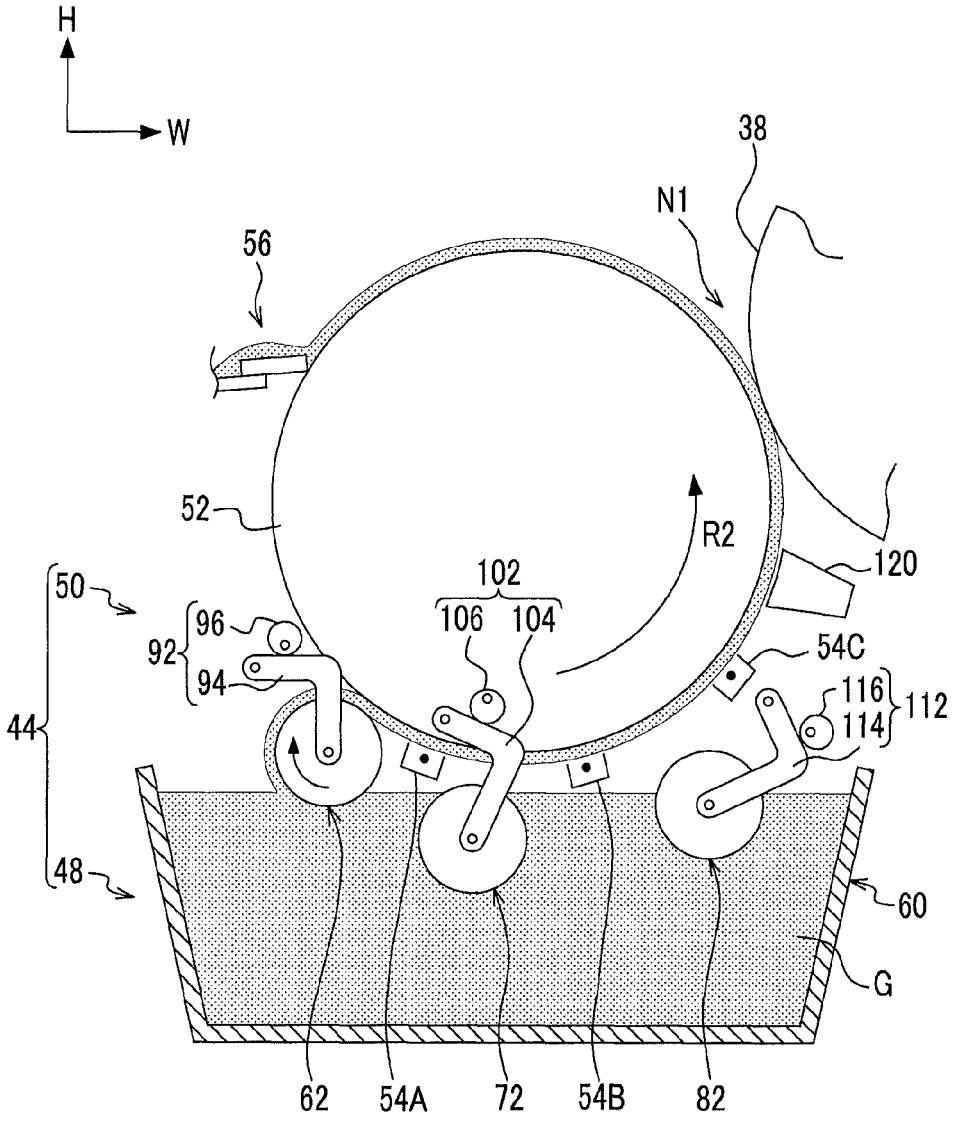
FIG. 2 is a configuration diagram illustrating the developing device according to the exemplary embodiment of the invention.

The control section 100 rotates the eccentric cam 96, thereby rotating the link 94. As illustrated in FIG. 2, the control section 100 moves the supply roller 62 to the supplying position.

Thereafter, the control section 100 applies a developing voltage to the developing roller 52, and forms an electric field between the outer peripheral surface of the developing roller 52 and the supply roller 62 in order to supply the liquid developer G to the outer peripheral surface of the developing roller 52 from the supply roller 62. The control section 100 causes driving means (not illustrated) to rotate the developing roller 52.

Thereafter, the control section 100 actuates the motor 68 (refer to FIG. 6) so as to rotate the supply roller 62. The rotating supply roller 62 draws up the liquid developer G accommodated in the accommodation vessel 60. The liquid developer G drawn up by the supply roller 62 is supplied to the outer peripheral surface of the developing roller 52. In this manner, a coat (layer) of the liquid developer G is formed on the outer peripheral surface of the developing roller 52. The detection member 120 detects the periodic information related to the thickness of the liquid developer G supplied to the outer peripheral surface of the developing roller 52 by the supply roller 62.

Figure 8:
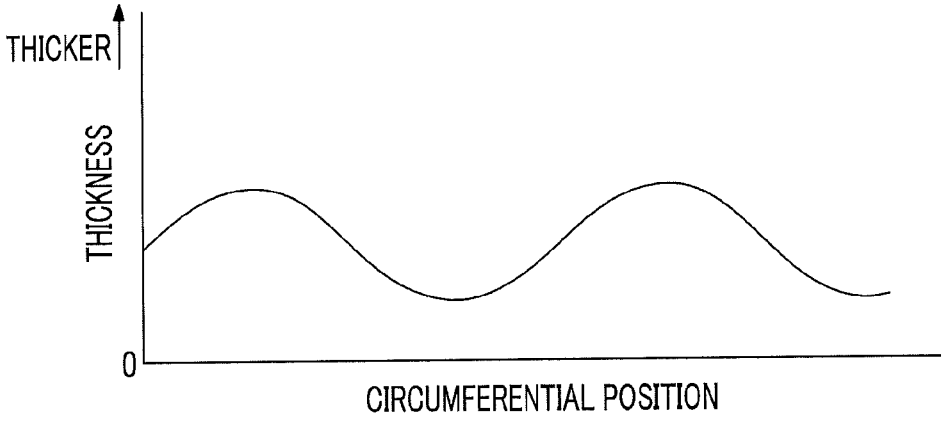
FIG. 8 is a chart illustrating a thickness of a liquid developer on a developing roller which is supplied by one supply roller used in the supply device according to the exemplary embodiment of the invention.

Here, the recesses 64A which are regularly disposed are formed on the outer peripheral surface of the main body portion 64 of the supply roller 62 (refer to FIGS. 5A and 5B). There is a difference between amounts of the liquid developer G which are drawn up by the recess 64A and a portion other than the recess 64A. According to this difference, the periodic information related to the thickness of the liquid developer G detected by the detection member 120 is understood as illustrated by a chart in FIG. 8. The vertical axis in FIG. 8 represents the thickness of the liquid developer G, and the horizontal axis represents a circumferential position of the developing roller 52. As illustrated by the chart in FIG. 8, the thickness of the liquid developer G increases and decreases periodically.

The detection member 120 detects the periodic information related to the thickness of the liquid developer G as illustrated by the chart in FIG. 8. For example, if the detection member 120 detects the periodic information related to the thickness of the liquid developer G which corresponds to one rotation of the supply roller 62, the control section 100 stores the rotation angle information of the supply roller 62, and stops the rotation of the supply roller 62 by releasing a clutch (not illustrated).

Thereafter, the control section 100 actuates the motor 98 so as to rotate the eccentric cam 96, and actuates the motor 108 so as to rotate the eccentric cam 106 (refer to FIG. 6).

Figure 3:
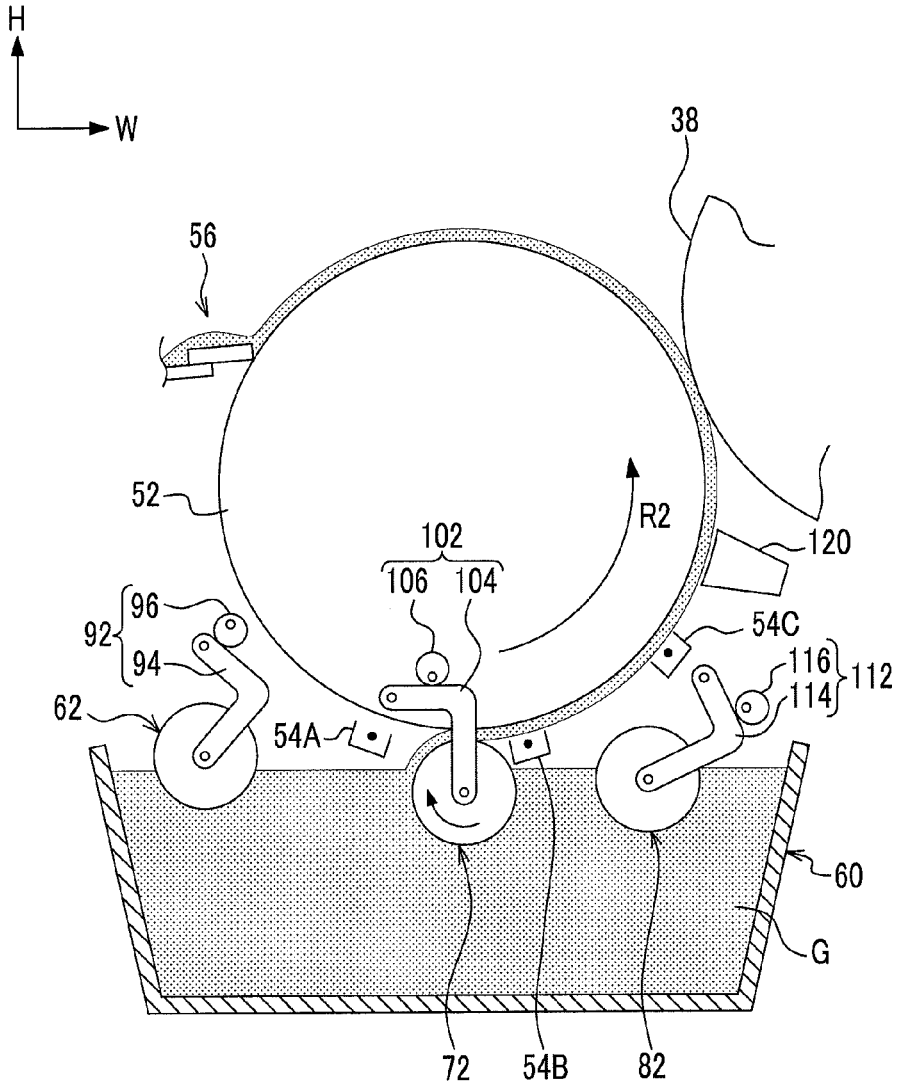
FIG. 3 is a configuration diagram illustrating the developing device according to the exemplary embodiment of the invention.

The control section 100 rotates the eccentric cam 96, thereby rotating the link 94. As illustrated in FIG. 3, the control section 100 moves the supply roller 62 to the separating position. The control section 100 rotates the eccentric cam 106, thereby rotating the link 104 and moving the supply roller 72 to the supplying position.

If the supply roller 72 is moved to the supplying position in this way, the collection blade 56 collects the liquid developer G remaining on the outer peripheral surface of the developing roller 52. Thereafter, the same process is performed as in the above-described case of the supply roller 62. The detection member 120 detects the periodic information related to the thickness of the liquid developer G supplied to the outer peripheral surface of the developing roller 52 by the supply roller 72.

Similarly to the case of the supply roller 62, the thickness of the liquid developer G supplied to the developing roller 52 by the supply roller 72 increases and decreases periodically. If the detection member 120 detects the periodic information related to the thickness of the liquid developer G, the control section 100 stores the rotation angle information of the supply roller 72, and stops the rotation of the supply roller 72 by releasing a clutch (not illustrated).

Thereafter, the control section 100 actuates the motor 108 so as to rotate the eccentric cam 106, and actuates the motor 118 so as to rotate the eccentric cam 116 (refer to FIG. 6).

Figure 4:
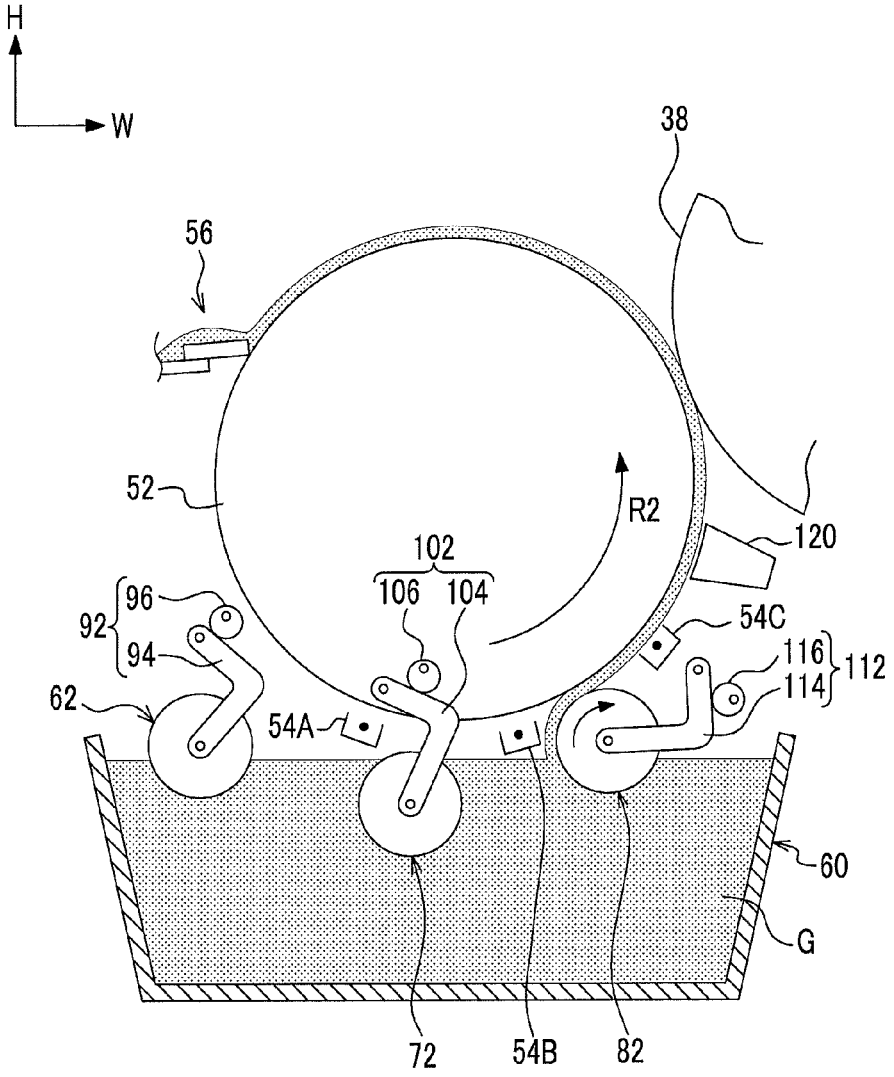
FIG. 4 is a configuration diagram illustrating the developing device according to the exemplary embodiment of the invention.

The control section 100 rotates the eccentric cam 106, thereby rotating the link 104. As illustrated in FIG. 4, the control section 100 moves the supply roller 72 to the separating position. The control section 100 rotates the eccentric cam 116, thereby rotating the link 114 and moving the supply roller 82 to the supplying position.

If the supply roller 82 is moved to the supplying position in this way, the collection blade 56 collects the liquid developer G remaining on the outer peripheral surface of the developing roller 52. Thereafter, the same process is performed as in the above-described case of the supply roller 62. The detection member 120 detects the periodic information related to the thickness of the liquid developer G supplied to the outer peripheral surface of the developing roller 52 by the supply roller 82. Similarly to the case of the supply roller 62, the thickness of the liquid developer G supplied to the developing roller 52 by the supply roller 82 increases and decreases periodically. If the detection member 120 detects the periodic information related to the thickness of the liquid developer G, the control section 100 stores the rotation angle information of the supply roller 82, and stops the rotation of the supply roller 82 by releasing a clutch (not illustrated).

The control section 100 actuates the motor 118 so as to rotate the eccentric cam 116. The control section 100 rotates the eccentric cam 116, thereby rotating the link 114 and moving the supply roller 82 to the separating position.

Thereafter, if a user inputs an instruction to form an image to the image forming apparatus 10, the control section 100 receives information related to paper types used as the continuous paper P in the image forming apparatus 10 from the input unit 130 (refer to FIG. 10). If surface roughness Ra (JIS B 0601) of the continuous paper P is equal to or greater than a predetermined value (for example, 2 μm), the control section 100 actuates the motor 98 so as to rotate the eccentric cam 96, and actuates the motor 108 so as to rotate the eccentric cam 106. The control section 100 actuates the motor 118 so as to rotate the eccentric cam 116 (refer to FIG. 6). In this manner, as illustrated in FIG. 1, the supply rollers 62, 72, and 82 are moved to the supplying position.

Thereafter, the control section 100 applies a developing voltage to the developing roller 52, and forms an electric field between the outer peripheral surface of the developing roller 52 and the supply rollers 62, 72, and 82 in order to supply the liquid developer G to the outer peripheral surface of the developing roller 52 from the supply rollers 62, 72, and 82. The control section 100 causes driving means (not illustrated) to rotate the developing roller 52.

Thereafter, the control section 100 controls a rotation starting time for the supply rollers 62, 72, and 82, based on each periodic information detected by the detection member 120 and the positional information of the supply rollers 62, 72, and 82.

Specifically, the control section 100 obtains the periodic information related to the thickness of the liquid developer G supplied to the developing roller 52 by the respective supply rollers 62, 72, and 82, the positional information among the respective supply rollers 62, 72, and 82, and the rotation angle information of the supply rollers 62, 72, and 82. The control section 100 controls a rotation starting time for the supply rollers 62, 72, and 82 so that peaks of the thickness of the liquid developer G supplied to the outer peripheral surface of the developing roller 52 by the supply rollers 62, 72, and 82 are shifted from each other. For example, the control section 100 controls the rotation starting time for the supply rollers 62, 72, and 82 so that the rotation angles of the supply roller 62, the supply roller 72, and the supply roller 82 are shifted from each other by 120 degrees. The peak of the thickness represents a peak position where the thickness of the liquid developer G becomes thickest in the developing roller 52.

As illustrated in FIG. 1, the toner contained in the liquid developer G supplied to the developing roller 52 by the supply roller 62 is charged by the charging member 54A before passing through the supply roller 72. This configuration prevents the thickness of the liquid developer G supplied to the developing roller 52 by the supply roller 62 from being changed since the liquid developer G passes through the supply roller 72 when the supply roller 72 is moved to the supplying position.

Similarly, the toner contained in the liquid developer G supplied to the developing roller 52 by the supply roller 72 is charged by the charging member 54B before passing through the supply roller 82. This configuration prevents the thickness of the liquid developer G supplied to the developing roller 52 by the supply roller 72 from being changed since the liquid developer G passes through the supply roller 82 when the supply roller 82 is moved to the supplying position.

The toner contained in the liquid developer G supplied to the developing roller 52 by the supply roller 82 is charged by the charging member 54C.

Figure 7:
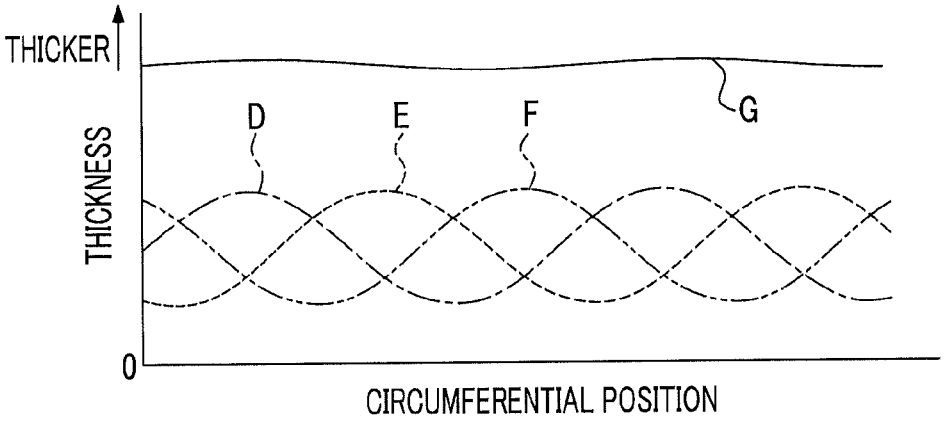
FIG. 7 is a chart illustrating a thickness of a liquid developer on a developing roller which is supplied by the supply rollers used in the supply device according to the exemplary embodiment of the invention.

FIG. 7 is a chart in which the vertical axis represents the thickness of the liquid developer G and the horizontal axis represents the circumferential position of the developing roller 52. A line D represents the thickness of the liquid developer G supplied to the outer peripheral surface of the developing roller 52 by the supply roller 62, and a line E represents the thickness of the liquid developer G supplied to the outer peripheral surface of the developing roller 52 by the supply roller 72. A line F represents the thickness of the liquid developer G supplied to the outer peripheral surface of the developing roller 52 by the supply roller 82.

As illustrated by the chart in FIG. 7, peaks of the thickness of the liquid developer G supplied to the outer peripheral surface of the developing roller 52 by the supply rollers 62, 72, and 82 are shifted from each other. As illustrated by a line G in the chart, this configuration prevents variations in the thickness of all coats of the liquid developer G which are formed in the developing roller 52.

If the surface roughness Ra (JIS B 0601) of the continuous paper P is smaller than a predetermined value (for example, 2 μm), the control section 100 moves the supply roller 72 and the supply roller 82 to the supplying position. The subsequent process is the same as the above-described process except that the supply roller 62 is not actuated.

Comparative Example

Next, an image forming apparatus 200 according to a comparative example of the exemplary embodiment will be described. The image forming apparatus 200 will be described by mainly focusing on points different from those of the image forming apparatus 10.

Figure 11:
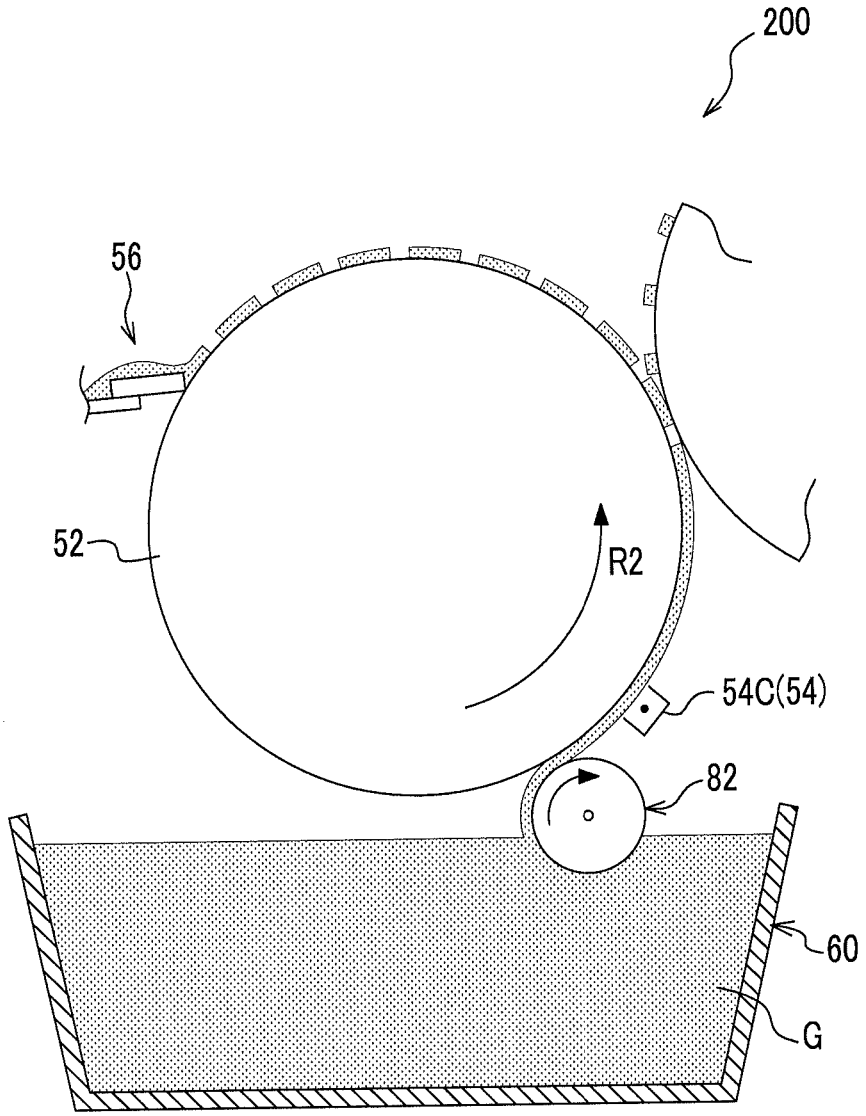
FIG. 11 is a configuration diagram illustrating a developing device included in an image forming apparatus according to a comparative example of the image forming apparatus according to the exemplary embodiment of the invention.

As illustrated in FIG. 11, the image forming apparatus 200 includes the supply roller 82 which supplies the liquid developer G to the developing roller 52, and does not include the other supply rollers. The supply roller 82 is always moved to the supplying position. The image forming apparatus 200 includes the charging member 54C in the charging member 54 for charging the toner contained in the liquid developer G supplied to the developing roller 52, and does not include the other charging members.

The thickness of the liquid developer G supplied to the developing roller 52 by the supply roller 82 increases and decreases periodically (refer to FIG. 8).

Figure 12:
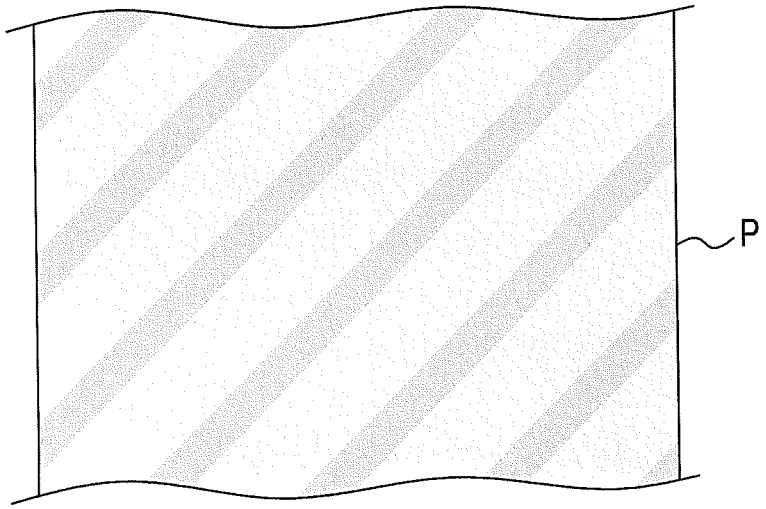
FIG. 12 is a schematic view illustrating an image output by the image forming apparatus according to the comparative example of the image forming apparatus according to the exemplary embodiment of the invention.

Therefore, for example, if a black solid image (area coverage of 100%) is formed by using the image forming apparatus 200, a Moire pattern (interference stripes) appears on the image output to the continuous paper P as illustrated in FIG. 12.

As described above, the control section 100 controls the rotation starting time for the supply rollers 62, 72, and 82 so that the peaks of the thickness of the liquid developer G supplied to the outer peripheral surface of the developing roller 52 by the supply rollers 62, 72, and 82 are shifted from each other. According to this configuration, as compared to the supply device according to the image forming apparatus 200, variations are prevented in the coat thickness of the liquid developer G formed on the outer peripheral surface of the developing roller 52 when the developing roller 52 develops the electrostatic latent image on the image holding member 38 to the toner image.

The supply section 48 includes the movement members 92, 102, and 112 which individually move the respective supply rollers 62, 72, and 82 to the supplying position and the separating position. For example, the control section 100 moves the supply roller 62 to the supplying position, and moves the other supply rollers 72 and 82 to the separating position. The detection member 120 individually detects the periodic information related to the thickness of the liquid developer G supplied to the outer peripheral surface of the developing roller 52 by the supply roller 62 moved to the supplying position.

In this way, any one of the supply rollers 62, 72, and 82 is moved to the supplying position. The detection member 120 individually detects the periodic information related to the thickness of the liquid developer G supplied to the outer peripheral surface of the developing roller 52 by the supply roller 62 moved to the supplying position. Therefore, detection accuracy is improved as compared to a case of detecting the periodic information related to the thickness of the liquid developer G in a state where multiple supply rollers are moved to the supplying position.

The supply section 48 includes the detection member 120 which detects the periodic information related to the thickness of the liquid developer G supplied to the outer peripheral surface of the developing roller 52 by the respective supply rollers 62, 72, and 82. According to this configuration, for example, even when the image forming apparatus 10 is shipped from a factory and the supply rollers 62, 72, and 82 are unintentionally rotated before the image forming apparatus 10 is delivered to a dealer or a user, variations are prevented in the coat thickness of the liquid developer G formed on the outer peripheral surface of the developing roller 52.

In the developing device 44, the toner contained in the liquid developer G supplied to the developing roller 52 by the supply roller 62 is charged by the charging member 54A before passing through the supply roller 72. This configuration prevents the thickness of the liquid developer G supplied to the developing roller 52 by the supply roller 62 from being changed since the liquid developer G passes through the supply roller 72 when the supply roller 72 is moved to the supplying position.

Similarly, the toner contained in the liquid developer G supplied to the developing roller 52 by the supply roller 72 is charged by the charging member 54B before passing through the supply roller 82. This configuration prevents the thickness of the liquid developer G supplied to the developing roller 52 by the supply roller 72 from being changed since the liquid developer G passes through the supply roller 82 when the supply roller 82 is moved to the supplying position.

When the surface roughness Ra of the continuous paper P is equal to or greater than a predetermined value (for example, 2 μm), as compared to a case where the surface roughness Ra of the continuous paper P is smaller than 2 μm, for example, the number of the supply rollers moved to the supplying position increases. Therefore, when the surface of the continuous paper P is rough, the thickness of the liquid developer G formed in the developing roller 52 becomes thicker. Accordingly, the thickness of the liquid developer G transferred to the continuous paper P also becomes thicker. Regardless that the surface of the continuous paper P is rough, a portion having the toner image becomes flat. Therefore, quality of an output image is prevented from being degraded due to the surface roughness Ra of the continuous paper P. That is, according to the surface roughness Ra of the continuous paper P, the thickness of the liquid developer G formed in the developing roller 58 is allowed to have a proper value.

In the image forming apparatus 10, variations are prevented in the coat thickness of the liquid developer G formed on the outer peripheral surface of the developing roller 52. Accordingly, a Moire pattern is prevented from appearing on the output image due to the coat thickness of the liquid developer G on the developing roller 52.

The specific exemplary embodiment has been described in detail. However, it will be apparent to those skilled in the art that the exemplary embodiment may be modified in various ways within the scope of the exemplary embodiment without being limited to the specific exemplary embodiment. For example, in the above-described exemplary embodiment, the image forming apparatus 10 includes the three supply rollers, but may include two supply rollers or four supply rollers.

In the above-described exemplary embodiment, the rotation starting time is controlled for the supply rollers 62, 72, and 82 so that the peaks of the thickness of the liquid developer G supplied to the outer peripheral surface of the developing roller 52 by the supply rollers 62, 72, and 82 are shifted from each other. However, peaks of the thickness of the liquid developer G supplied by any two of the supply rollers may be shifted, or peaks of the thickness of the liquid developer G supplied by all supply rollers may not be shifted from one another.

In the above-described exemplary embodiment, when the power is supplied to the image forming apparatus 10 for the first time, the control section 100 controls the rotation starting time for the supply rollers 62, 72, and 82 so that the peaks of the thickness of the liquid developer G supplied to the outer peripheral surface of the developing roller 52 by the supply rollers 62, 72, and 82 are shifted from each other. However, for example, when a positional relationship of the supply rollers is changed, such as when any one of the supply rollers is replaced, the above-described control may be performed. Even if the rotation angle of the replaced supply roller is recognized, since the supply section 48 includes the detection member 120 as described above, variations are prevented in the coat thickness of the liquid developer G formed on the outer peripheral surface of the developing roller 52.

In the above-described exemplary embodiment, the multiple recesses 64A are formed in an annular shape on the outer peripheral surface of the main body portion 64, and are tilted to the axial direction of the supply roller 62. However, the recess may be formed in a spiral shape on the outer surface of the main body portion. Alternatively, multiple recesses may be formed so as to extend in the axial direction of the supply roller.

In the above-described exemplary embodiment, the supply roller 62, the supply roller 72, and the supply roller 82 have been described by citing an example of the roller in which the recesses are regularly disposed on the outer peripheral surface. However, the outer peripheral surface may have a honeycomb shape (so-called honeycomb structure), or the outer peripheral surface may have a shape having continuous mountains and valleys (so-called art structure).

In the above-described exemplary embodiment, when the supply roller 62, the supply roller 72, and the supply roller 82 are moved to the supplying position, the control section 100 controls the rotation starting time for the supply roller 62, the supply roller 72, and the supply roller 82 so that the rotation angles thereof are shifted from each other by 120 degrees. However, when any two supply rollers are moved to the supplying position, the control section 100 may control the rotation starting time for the supply rollers so that the rotation angles are shifted from each other by 180 degrees.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A supply device for a liquid developer comprising:

a plurality of supply members; and a control section, wherein each of the supply member has a cylindrical shape with recesses regularly disposed on an outer peripheral surface, faces a developing member developing while rotating, draws up the liquid developer accommodated in an accommodation section while rotating, supplies the liquid developer to the outer peripheral surface of the developing member, and is arranged along a rotation direction of the developing member, and wherein when the developing member develops, the control section controls a rotation starting time for the plurality of supply members so that a position of a peak of a thickness of the liquid developer supplied to the outer peripheral surface of the developing member by a first supply member is different from a position of a peak of a thickness of the liquid developer supplied to the outer peripheral surface of the developing member by a second supply member.

2. The supply device of a liquid developer according to claim 1, further comprising:

a movement member that moves the supply member to a supplying position facing the developing member and a separating position separated from the developing member.

3. The supply device of a liquid developer according to claim 2, wherein the control section controls to change a number of the supply members moving to the supplying position based on surface roughness of a recording medium to which a toner image is transferred, and controls a rotation starting time for the plurality of supply members so that the position of the peaks of the thickness of the liquid developer supplied to the outer peripheral surface of the developing member by the plurality of supply members located to the supplying position are different from each other.

4. The supply device of a liquid developer according to claim 1, further comprising:

a detection member that detects periodic information related to the thickness of the liquid developer supplied to the outer peripheral surface of the developing member by the first supply member and periodic information related to the thickness of the liquid developer supplied to the outer peripheral surface of the developing member by the second supply member, before the developing member develops, wherein the control section controls a rotation starting time of the supply member, based on each periodic information detected by the detection member and positional information of the supply member.

5. The supply device of a liquid developer according to claim 4, further comprising:

a movement member that moves the supply member to a supplying position facing the developing member and a separating position separated from the developing member.

6. The supply device of a liquid developer according to claim 5, wherein the control section controls the movement member to move any one of supply members to the supplying position, and wherein the detection member detects the periodic information related to the thickness of the liquid developer supplied to the outer peripheral surface of the developing member by the supply member moved to the supplying position.

7. The supply device of a liquid developer according to claim 5, wherein the control section controls to change a number of the supply members moving to the supplying position based on surface roughness of a recording medium to which a toner image is transferred, and controls a rotation starting time for the plurality of supply members so that the position of the peaks of the thickness of the liquid developer supplied to the outer peripheral surface of the developing member by the plurality of supply members located to the supplying position are different from each other.

8. A developing device comprising:

a developing member that develops an electrostatic latent image on an image holding member by using a liquid developer while rotating;

a supply device for a liquid developer that supplies the liquid developer to an outer peripheral surface of the developing member; and a control section, wherein the supply device for the liquid developer includes a plurality of supply members, and each of the supply member has a cylindrical shape with recesses regularly disposed on an outer peripheral surface, faces the developing member developing while rotating, draws up the liquid developer accommodated in an accommodation section while rotating, supplies the liquid developer to the outer peripheral surface of the developing member, and is arranged along a rotation direction of the developing member, and wherein when the developing member develops, the control section controls a rotation starting time for the plurality of supply members so that a position of a peak of a thickness of the liquid developer supplied to the outer peripheral surface of the developing member by a first supply member is different from a position of a peak of a thickness of the liquid developer supplied to the outer peripheral surface of the developing member by a second supply member.

9. The developing device according to claim 8, further comprising:

a detection member that detects periodic information related to the thickness of the liquid developer supplied to the outer peripheral surface of the developing member by the first supply member and periodic information related to the thickness of the liquid developer supplied to the outer peripheral surface of the developing member by the second supply member, before the developing member develops, wherein the control section controls a rotation starting time of the supply member, based on each periodic information detected by the detection member and positional information of the supply member.

10. The developing device according to claim 8, further comprising:

a charging member that charges toner contained in the liquid developer supplied to the outer peripheral surface of the developing member by a first supply member on a downstream side of the first supply member and an upstream side of the second supply member in the rotation direction of the developing member.

11. The developing device according to claim 8, wherein the supply device has a movement member and the movement member moves the supply member to a supplying position facing the developing member and a separating position separated from the developing member.

12. The developing device according to claim 8, wherein the control section controls to change a number of the supply members moving to the supplying position based on surface roughness of a recording medium to which a toner image is transferred, and controls a rotation starting time for the plurality of supply members so that the position of the peaks of the thickness of the liquid developer supplied to the outer peripheral surface of the developing member by the plurality of supply members located to the supplying position are different from each other.

13. The developing device according to claim 9, wherein the supply device has a movement member, and the movement member moves the supply member to an supplying position facing the developing member and a separating position separated from the developing member.

14. The developing device according to claim 9, wherein the control section controls the movement member to move any one of the supply members to the supplying position, and wherein the detection member detects the periodic information related to the thickness of the liquid developer supplied to the outer peripheral surface of the developing member by the supply member moved to the supplying position.

15. An image forming apparatus comprising:

an image holding member on which an electrostatic latent image is formed;

the developing device according to claim 8 that develops the electrostatic latent image formed on the image holding member to a toner image using a liquid developer; and a transfer member that transfers the toner image formed on the image holding member to a recording medium.

16. The image forming apparatus according to claim 15, wherein the developing device includes a detection member that detects periodic information related to the thickness of the liquid developer supplied to the outer peripheral surface of the developing member by the first supply member and periodic information related to the thickness of the liquid developer supplied to the outer peripheral surface of the developing member by the second supply member, before the developing member develops, and wherein the control section controls a rotation starting time of the supply member, based on each periodic information detected by the detection member and positional information of the supply member.

* * * * *